US005118995A

United States Patent [19]

Hauser

[11] Patent Number: 5,118,995

[45] Date of Patent: Jun. 2, 1992

[54] LIGHTING AND FLASH DEVICE

[75] Inventor: Hans-Peter Hauser, Rheinfelden, Switzerland

[73] Assignee: Bron Elektronik AG, Allschwil, Switzerland

[21] Appl. No.: 589,165

[22] Filed: Sep. 27, 1990

[30] Foreign Application Priority Data

Sep. 27, 1989 [DE] Fed. Rep. of Germany ..... 3932123

[51] Int. Cl.[5] ..... H05B 41/37

[52] U.S. Cl. ..... 315/241 R; 315/241 P; 315/240; 315/241 S

[58] Field of Search ..... 315/241 P, 241 R, 240, 315/241 S, 171, 173, 160; 320/1; 328/66; 354/418

[56] References Cited

U.S. PATENT DOCUMENTS

| | | | |
|---|---|---|---|
| 4,467,248 | 8/1984 | Watanabe et al. | 315/241 P |
| 4,530,550 | 7/1985 | Kondo | 315/241 P |
| 4,748,382 | 5/1988 | Walker | 315/241 P |
| 4,853,600 | 8/1989 | Zeltner et al. | 315/241 P |

*Primary Examiner*—Eugene R. LaRoche
*Assistant Examiner*—Ali Neyzari
*Attorney, Agent, or Firm*—Robert W. Becker & Associates

[57] ABSTRACT

A lighting and flash device comprises a flash tube with a corresponding ignition device and at least two energy storage device units. The voltage of the energy storage device units is independently adjustable. When the voltage of the energy storage device units is accordingly divided, the resulting color temperature, in practice, is held relatively constant within allowable limits.

4 Claims, 2 Drawing Sheets

LIGHTING AND FLASH DEVICE

BACKGROUND OF THE INVENTION

The present invention relates to a lighting and flash device with at least one flash tube and corresponding ignition device and at least two energy storage devices in the form of flash capacitors It is known that the color temperature of flash devices varies when the power is changed due to varying the voltage of the energy storage devices. A higher voltage results in a more bluish light, i e., a higher color temperature, and a lower voltage results in a lower color temperature, i.e., a more yellowish light.

It is known that the flash power may be changed by switching on and off energy storage devices of the same voltage. However, the power changes may only be achieved in large increments, so that a fine and exact tuning of the flash power is impossible.

From the DE-OS 36 12 164 it is known, that a combination of an amplitude control and a time control may be used for a lighting and flash device in order to achieve the desired color temperature for the delivered amount of light. By selecting a suitable supply voltage, i.e., the amplitude, and flash duration, the desired color temperature may be adjusted for a given amount of light. This device, however, is expensive because of the type of semiconductors employed for this power range.

It is therefore an object of the present invention to provide a lighting and flash device with at least one flash tube and corresponding ignition device and at least two energy storage device units in the form of flash capacitors, which achieves a stabilization of the color temperature by simple and inexpensive means.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The lighting and flash device of the present invention is primarily characterized by the voltage of each energy storage device unit being independently adjustable.

In the device according to the present invention, the entire energy storage device is divided into at least two energy storage device units, whereby the voltage of each portion may be independently adjusted. When the energy storage device units are fully charged, the flash power is at its maximum. In order to reduce the flash power, the voltage of one of the energy storage device units is successively reduced to zero while the other energy storage device unit may be operated at full voltage. The resulting color temperature is then a mixture of the fractions of the color temperature resulting from the respective energy storage device unit. If the voltage is divided accordingly between the energy storage device unit, the color temperature may be kept at a constant value within acceptable limits. At the same time, a very fine gradation of the light emission is achieved due to the energy storage device unit in which the voltage adjustment may be carried out in very small increments.

DESCRIPTION OF PREFERRED EMBODIMENTS

Figure 1:
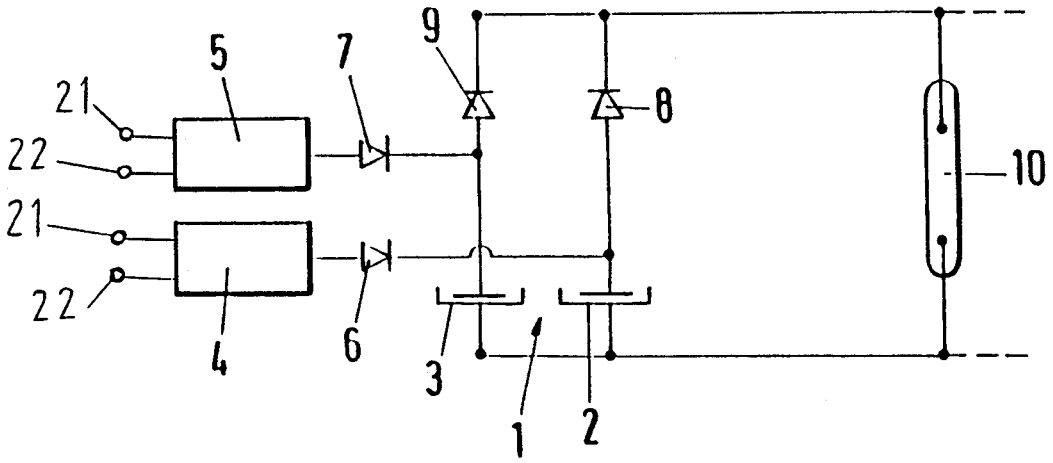
FIG. 1 is a schematic diagram of a flash device according to the present invention.
Figure 2:
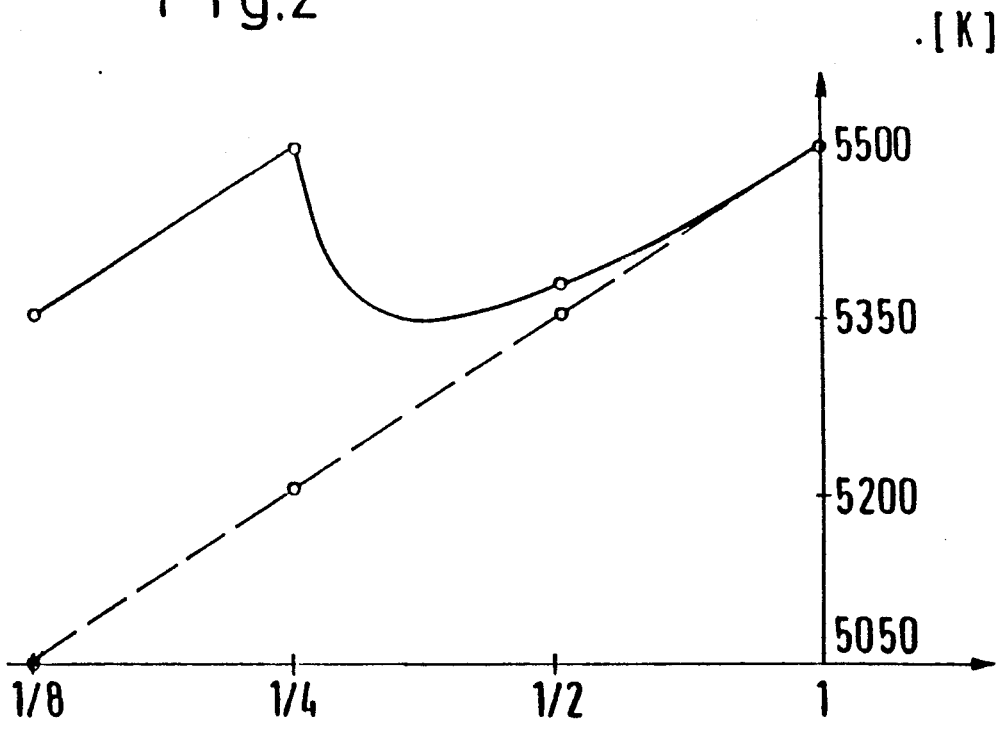
FIG. 2 shows a graph demonstrating the dependence of the color temperature on the flash power in a flash device according to the present invention.
Figure 3:
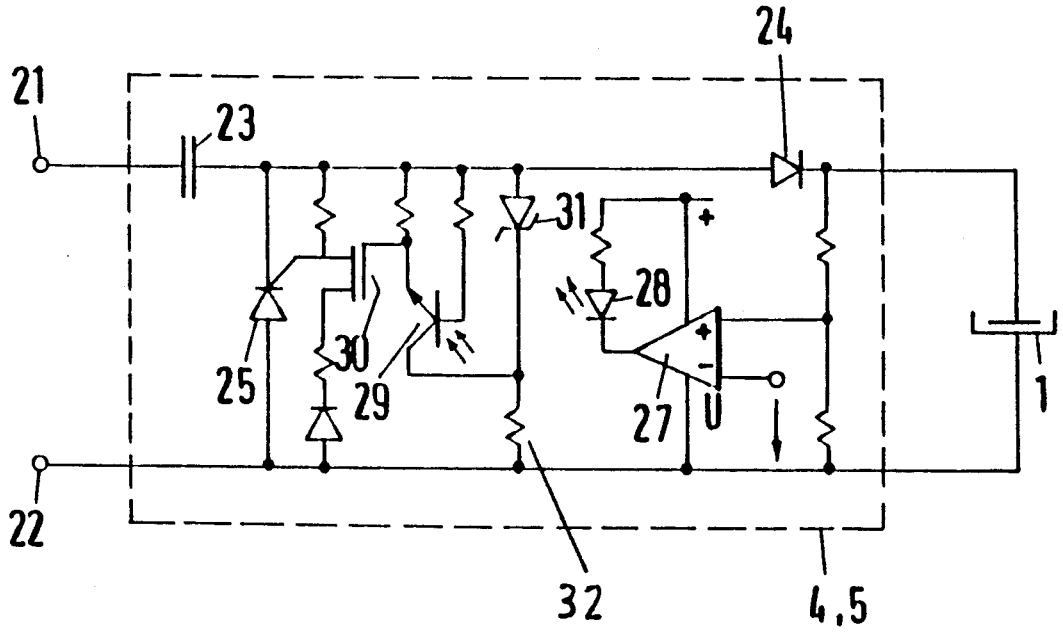
FIG. 3 is a schematic diagram of a supply voltage control unit of a flash device according to the present invention.

The present invention will now be described in detail with the aid of several specific embodiments utilizing FIGS. 1 through 3.

The color temperature of flash devices may be varied by adjusting their flash power due to changing the voltage of the energy storage device units, preferably electrolyte capacitors. A higher voltage results in a higher color temperature, i.e., a more bluish light. A lower voltage accordingly results in a lower color temperature, i.e., a more yellowish light. With the embodiment described in the following paragraphs, it is possible, independent of the respective flash power, to maintain the color temperature at a constant or to adjust to a certain color temperature. With this flash device, it is therefore possible to make photographs with an optimum color temperature. It is also possible to obtain the same color temperatures for different flash powers.

In order to achieve a stabilization of the color temperature by simple and inexpensive means, the energy storage device 1 of the flash device, preferably a flash capacitor, is divided into single energy storage device units 2 and 3. The voltage of each energy storage device unit 2 or 3 is independently adjustable. Each single energy storage device unit 2 or 3 is equipped with a supply voltage control unit 4 and 5 for the adjustment of the supply voltage. To each supply voltage control unit 4 or 5 there is connected one rectifier such as a diode. Via the rectifier 8 or 9, respectively, the energy storage device units 2 and 3 are connected in series to at least one flash tube 10. In order to simplify the drawing, the embodiment represented in FIG. 1 is equipped with only two energy storage device units 2 and 3. However, the energy storage device 1 may be divided into more than two energy storage device units, preferably flash electrolyte capacitors, whereby the voltage of each energy storage device unit is still independently adjustable.

Preferably, the two supply voltage control units are of an identical structure. The alternating current between the power supply contacts 21, 22 (FIG. 3) runs a doubler circuit, comprising a capacitor 23, a diode 24 and a thyristor 25. The doubler circuit charges the flash capacitor 1 as long as the thyristor 25 receives a control signal at its gate. The control of the thyristor 25 is achieved by comparing the current flash voltage at the flash capacitor 1 to the preset value in a comparator 27. If the current voltage at the flash capacitor 1 is lower than the preset value, the comparator 27 switches an opto coupler comprising a diode 28 and a photo transistor 29 whereby the thyristor 25 receives a control signal via the photo transistor 29 and the FET (field effect transistor) 30. When the preset value of the voltage is reached, the comparator tilts and the control signal ceases, so that the doubler circuit stops charging the flash capacitor 1. A break-down diode 31 together with a resist 32 feeds this control circuit.

In order to achieve a minimized deviation of the color temperature the energy is distributed to the energy storage device units 2 and 3 such that the desired color is nearly constant. If, for example, the flash power is reduced from its maximum value, the voltage of one single energy storage device unit is first successively reduced to zero, while the other energy storage device units are still operated at full voltage. The resulting color temperature therefore is a mixture of the fractions of the color temperature resulting from the respective energy storage device units. If the voltage is divided accordingly between the energy storage device units, the color temperature may be kept at a constant value within acceptable limits. In the following paragraphs, with the aid of the FIGS. 2 and 3, this will be explained in more detail for the division of the energy storage device 1 into the energy storage units 2 and 3.

When the total capacity of the energy storage device is, for example, equal to 1, then the capacity of the energy storage device unit 2 is $\frac{3}{4}$ and the capacity of the energy storage device unit 3 is $\frac{1}{4}$ of the total capacity. The values given in the following paragraphs are based on the assumption that the color temperature varies by 150 K. per step in aperture, if the flash voltage is changed by a factor of $\sqrt{2}$. In this case a step in aperture corresponds to a reduction of the flash power by 50%. It is also assumed that the deviation of the color temperature should be minimal within a variation of three steps in aperture.

When the full flash power is available, then the two energy storage device units are charged to 100%. When the flash is released, the color temperature is then 5,500 K. When the flash energy is reduced by half, it is sufficient to charge the energy storage device unit 3 to 100% while the energy storage device unit 2 is charged only to $\frac{1}{8}$ of its capacity. Both energy storage device units combined then deliver one half of the flash power. As shown in FIG. 2, the color temperature (solid line) is only slightly reduced. The reduction is less than 150 K. As a comparison, the reduction in color temperature for only a single energy storage device 1 is represented by the dashed line in FIG. 2. This slight reduction in color temperature is usually not noticeable and is therefore unimportant for the majority of photographs taken.

When the flash power is reduced further by 50%, a total reduction to $\frac{1}{4}$ of the initial value, the energy storage device portion 2 is no longer charged, while the energy storage device unit 3 is charged to 100%. Since, in this case, the energy storage device unit 2 does not contribute to the color temperature, the total color temperature is again 5,500 K. In a conventional flash device with only one energy storage device, the color temperature would have dropped to 5,200 K (dashed line in FIG. 2) under the given conditions.

When the flash power is again cut in half, resulting in a reduction to only $\frac{1}{8}$ of the initial value, the energy storage device unit 3 is only charged to 50% while the energy storage device unit 2 is not charged. This results in a slight reduction of the color temperature to 5,300° K. In a conventional flash device with only one energy storage device, the color temperature would have dropped to 5,050° K. under the given conditions.

As demonstrated by this example, the color temperature is a mixture of the fractions of the different energy storage device units 2 and 3. The capacity of the energy storage device unit may be chosen such that, independent of the respective flash power, the color temperature may be kept constant within fairly narrow limits. When more than two energy storage device units are used, the variations of the color temperature, for different flash powers, may be achieved within even narrower limits than demonstrated by the aforementioned example.

As shown in the example described above, the color temperature is theoretically not constant but may be kept within allowable limits in practice. At the same time, a very fine tuning of the light emission may be achieved, because the voltage in the individual energy storage device units may be varied in small increments.

In the embodiment described above, the operation of the flash device has been explained for three steps in aperture. It is, of course, possible to employ more or fewer steps in aperture whereby the capacity of the energy storage device units of the energy storage device 1 may be chosen such that, independent of the flash power, the color temperature is held relatively constant within given limits. However, the described operative mode does not change.

The present invention is, of course, in no way restricted to the specific disclosure of the specification, examples and drawings, but also encompasses any modifications within the scope of the appended claims.

What I claim is:

1. A lighting and flash device with at least one flash tube and corresponding ignition device and at least two energy storage device units in the form of flash capacitors, with the voltage of each said energy storage device unit being independently adjustable for an approximate stabilization of a color temperature of a flash, said energy storage device units being connected to said flash tube and having coordinated therewith a respective supply voltage control unit; and further comprising respective means for independently adjusting the voltage of each said energy storage device unit, said means including a comparator for determining a voltage level at said energy storage device unit and generating a control signal if said voltage level is below a preset value; and means to receive said control signal from said comparator and to supply voltage to said energy storage device unit in response to said control signal.

2. A lighting and flash device according to claim 1, in which said voltage of said energy storage device units is adjustable in a stepwise manner.

3. A lighting and flash device according to claim 1, in which said voltage of said energy storage device units is continuously adjustable.

4. A lighting and flash device according to claim 1, in which said energy storage device units have different maximum capacities.

* * * * *